United States Patent [19]

Liu

[11] Patent Number: 4,830,035

[45] Date of Patent: May 16, 1989

[54] SEESAWLY-CONTROLLED FOLDABLE WALKER

[76] Inventor: Antony Ching-Fong Liu, P O. Box 67-1245, Taipei, Taiwan

[21] Appl. No.: 49,309

[22] Filed: May 13, 1987

[51] Int. Cl.[4] ..... A61H 3/00

[52] U.S. Cl. ..... 135/67; 403/108; 403/325; 403/327

[58] Field of Search ..... 135/67; 272/70.3; 297/5, 6; 248/408, 409; 403/311, 108, 325, 327, 328, 330

[56] References Cited

U.S. PATENT DOCUMENTS

| | | | |
|---|---|---|---|
| 799,623 | 9/1905 | Augensen | 403/311 |
| 2,556,121 | 6/1951 | Thomas | 272/70.3 |
| 3,945,389 | 3/1976 | Smith | 135/67 |
| 4,056,115 | 11/1977 | Thomas | 135/67 |
| 4,180,086 | 12/1979 | Thomas | 135/67 |
| 4,298,016 | 11/1981 | Garelick | 135/67 |

FOREIGN PATENT DOCUMENTS

| | | | |
|---|---|---|---|
| 919044 | 2/1963 | United Kingdom | 272/70.3 |

*Primary Examiner*—Robert A. Hafer
*Assistant Examiner*—Charles H. Sam

[57] ABSTRACT

A foldable walker includes a pair of side walking legs pivotally mounted on a pair of T joints, a front transverse bar secured between the two T joints, a pair of foldable links each pivotally connected between each T joint and each side walking leg, and a pair of seesaw controllers each fixed on an outer tube of a link and seesawly biasing a locking button resiliently retained in an inner tube of the link, whereby upon the depressing of the button by the seesaw controller, the inner tube will be telescopically received within the outer tube when folding the side walking legs toward the front bar, thereby resulting in a simpler, quicker and more convenient folding operation of the walker.

1 Claim, 3 Drawing Sheets

SEESAWLY-CONTROLLED FOLDABLE WALKER

BACKGROUND OF THE INVENTION

Battiston, Sr. et. al. disclosed a foldable walker with plunger actuated latch assembly in their U.S. Pat. No. 4,518,002, including a locking assembly, having a spring biased reciprocating latch, a plunger attached to the latch, and a catch plate adapted to releasably engage the latch, which is mounted on a pair of gate legs and a cross brace adjacent the extremities of the legs, to be adapted for releasably locking the gate legs in an open position with respect to the cross brace. However, such a conventional foldable walker has the following defects:

1. Since the latch (2) is always retained by a spring positioned thereunder, when it is intended to fold the side gate legs toward the front cross brace, one hand of an user must depress the plunger (4) to disengage the catch (6) from the latch (2) and the other hand of the user should hold the gate legs and rotate the same for their collapsible operation, to thereby cause inconvenience especially for disabled patient.

2. When extending the gate legs for walking aid, the side leg is rotated around the axis of the sleeve (14) to allow the catch (6) to engage with the latch (2) for locking the legs, whereby the inclined mouth (46) of the catch (6) must be able to slide over the beveled surfaces of cam (26) of the latch (2) and will bear a strong resilient force against the spring (34) positioned under the latch (2) which seems to be a heavy burden for a weak patient subject to an ambulatory training.

3. After folding the side legs with the front brace to be a compact unit, the catch plates (6) will be protruded outwardly to possibly impede the environmental objects and also influence the homogeneous appearance of the walker.

The present inventor has found these defects of such a conventional walker and invented the present seesawly-controlled foldable walker.

SUMMARY OF THE INVENTION

The object of the present invention is to provide a foldable walker including a pair of side walking members pivotally mounted on a pair of T-joint means, a front transverse bar secured between the two T-joint means, a pair of foldable linking members each pivotally connected between each T-joint means and each side walking member, and a pair of seesaw controllers each fixed on an outer tube of each linking member and seesawly biasing a locking button resiliently retained in an inner tube, whereby upon the depressing of the button by the seesaw controller, the inner tube will be telescopically received within the outer tube when folding the side walking member toward the front bar; and upon the releasing of the button as restored by a restoring spring held in the inner tube, the side member can be extended outwardly until being stably locked when the button engages with a button hole formed through the outer tube and a cylindrical portion fixed on the outer tube, thereby resulting in a simpler, quicker and more convenient folding or extension operation of the walker.

DETAILED DESCRIPTION

Figure 1:
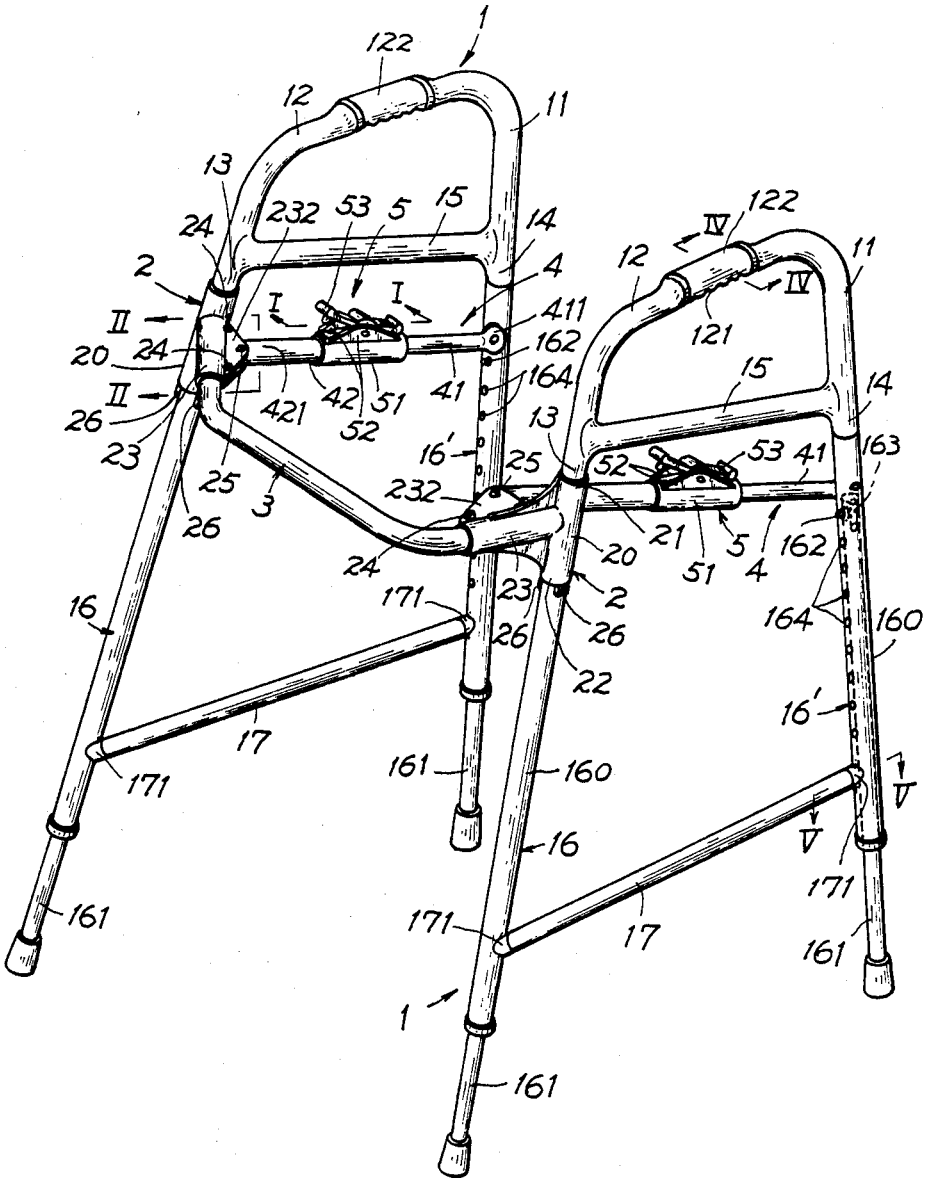
FIG. 1 is a perspective view of the present invention.

As shown in the figures, the present invention comprises: a pair of side walking members 1, a pair of T-joint means 2, a front transverse bar 3, a pair of foldable linking members 4 and a pair of seesaw controller 5.

Each side walking member 1 includes: a D-shaped upper handle 11 having an upper bar 12 formed with a grip portion 121 on its central portion and fixed with a cover 122, a front bar 13 and a rear bar 14 both extending downwardly from the upper bar 12, and a lower bar 15 secured between the two bars 13, 14 at their lower portions; a pair of telescopic feet 16, 16' respectively connected with the front bar and with the rear bar; and a lower brace 17 secured between the two telescopic feet 16, 16' at their lower portions.

Figure 4:
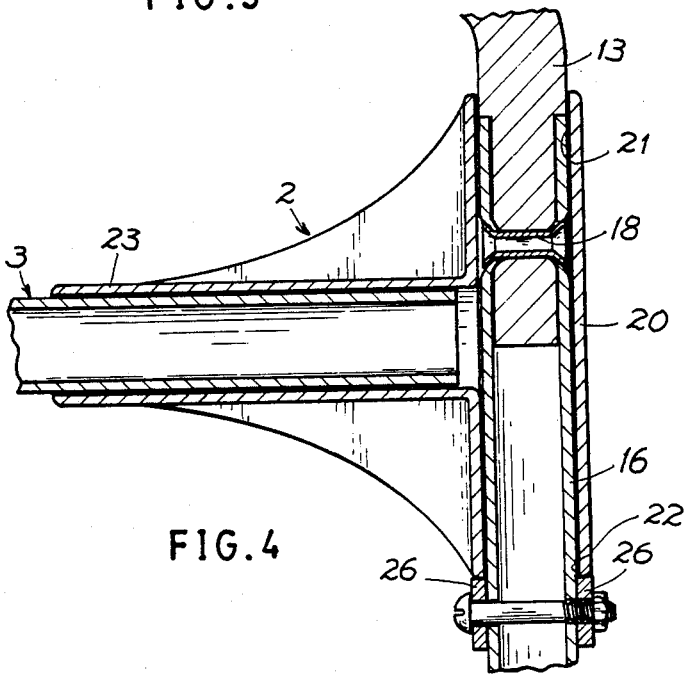
FIG. 4 is a sectional illustration showing the assembly of the side walking member and the front bar with a T-joint means in accordance with the present invention.

The lower end of the front bar 13 is connected with the upper end of the front telescopic foot 16 by a rivet 18 as shown in FIG. 4 and both are concealedly inserted into a vertical sleeve tube 20 of a T-joint means 2. A screw 26 is transversely fixed on the upper portion of the telescopic foot 16 as positioned under the lower opening 22 of the T-joint means 2 to limit the T-joint means 2 from its downward movement.

Figure 7:
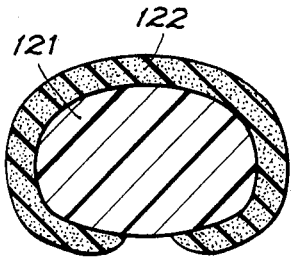
FIG. 7 is a sectional drawing of the grip portion of the present invention as viewed from IV—IV direction of FIG. 1.
Figure 8:
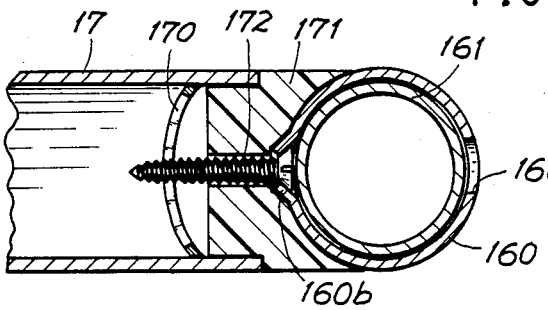
FIG. 8 shows the connection of a lower brace with a telescopic foot of the presnet invention as viewed from V—V direction of FIG. 1.

Each telescopic foot 16 includes an inner rod 161 telescopically mounted in an outer cylinder 160. The inner rod 161 is adjustably locked on the outer cylinder 160 by selectively engaging a button 162 resiliently retained by spring 163 fixed in the inner rod 161, with any one of the holes 164 longitudinally formed on the outer cylinder 160, so that the inner rod 161 can be adjustably mounted in the outer cylinder 160 to adjust the height of the walker of the present invention. The D-shaped upper handle 11 and the T-joint means 2 can be made by injection or blow molding of a suitable plastic material of heavy duty degree. The cover 122 as shown in FIG. 7, once damaged, can be replaced with any new one which may be coated, embedded, adhered or fixed on the grip portion 121 by a wellknown method. Such a cover 122 may be made of a foam or any other elastomer material. As shown in FIG. 8, each end of the lower brace 17 is secured to each telescopic foot 16 or 16' by fixing a screw 172 through an outer opening **160*a*, an inner opening 160*b* on outer cylinder 160, a packing medium 171 inserted between the foot 16 and the brace 17, finally to an end plate 170 plugged in the brace 17. The screw 172** is concealedly secured between the outer cylinder and the end plate.

Figure 5:
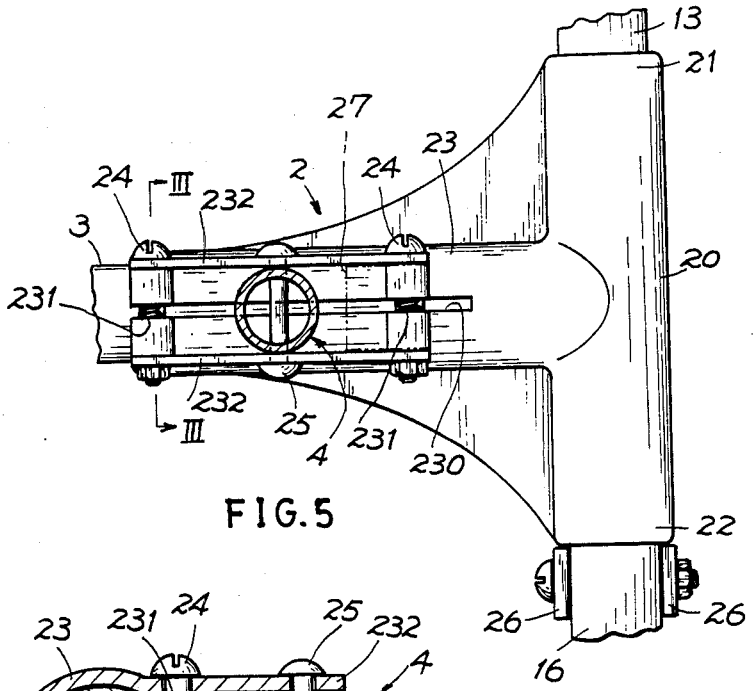
FIG. 5 shows a T-joint means of the present invention when viewed from II—II direction of FIG. 1.
Figure 6:
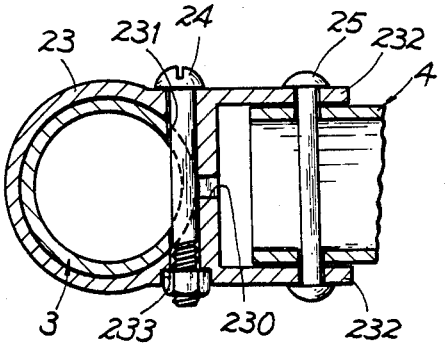
FIG. 6 is a sectional drawing of the T-joint means when viewed from III—III direction of FIG. 5.

The T-joint means 2, as shown in FIGS. 1, 5 and 6, includes: a vertical sleeve tube 20 having an upper opening 21 adapted for inserting the front bar 13 and a lower opening 22 for inserting the front telescopic foot 16, a horizontal tube 23 protruding frontwardly and outwardly in a direction separating from the vertical sleeve tube 20 for the insertion of a respective one end of the front transverse bar 3 so as to combine the two side walking members 1, a longitudinal notch 230 formed on the wall of the tube 23 projectively corresponding to the axis of the tube 23, two triangle-shaped flanges 232 disposed on both upper and lower sides of the notch 230 protruding in a rearwardly transverse direction, a pair of setting screws 24 each engaging with a vertical groove 231 formed on the outer end of the bar 3 and each vertically secured between the two flanges 232 to thereby fasten the notched tube 23 with the bar 3, and a pivotting screw 25 secured between the two flanges 232 and positioned at the central portion of the flanges 232 for pivotally securing a front end 421 of an outer tube 42 of the foldable linking member 4. For stabilizing the fixation of each screw 24 on the notched tube 23, a hexagonal or polygonal recess 233 is formed on the tube to snugly fix the polygonal nut of the screw into the recess to prevent its loosening after service for a long time.

The foldable linking member 4 includes an inner tube 41 having its rear end 411 pivotally secured to an upper portion of a rear telescopic foot 16' and having a front end 412, and an outer tube 42 having its front end 412 pivotally secured on the pivotting screw 25 and having its rear end 422 telescopically receiving the front end 412 of the inner tube 41.

The seesaw controller 5 includes: a cylindrical portion 51 fixed on the rear portion of the outer tube 42 and having a first button hole 511 and a second button hole 512 respectively disposed on two sides proximate to the two extremities of the cylindrical portion 51; a bracket 52 formed on the cylindrical portion 51; a seesaw actuator 53 having its central portion pivotally secured on the bracket 52 and having two beads 531, 532 respectively extending downwardly from its two ends and operatively poking through two button holes 511, 512 of the cylindrical portion 51 and poking through two button holes 423, 424 formed on the rear portion of the outer tube 42 corresponding to the two holes 511, 512; and a locking button 54 extending upwardly through a button hole 413 formed on the inner tube 41 proximate to it front end 412, as resiliently retained by a restoring spring 55 fixed in the inner tube 41. The seesaw actuator 53 operatively seesawly biases to depress the button 54 extending through either holes 423, 511 or holes 424, 512.

Figure 2:
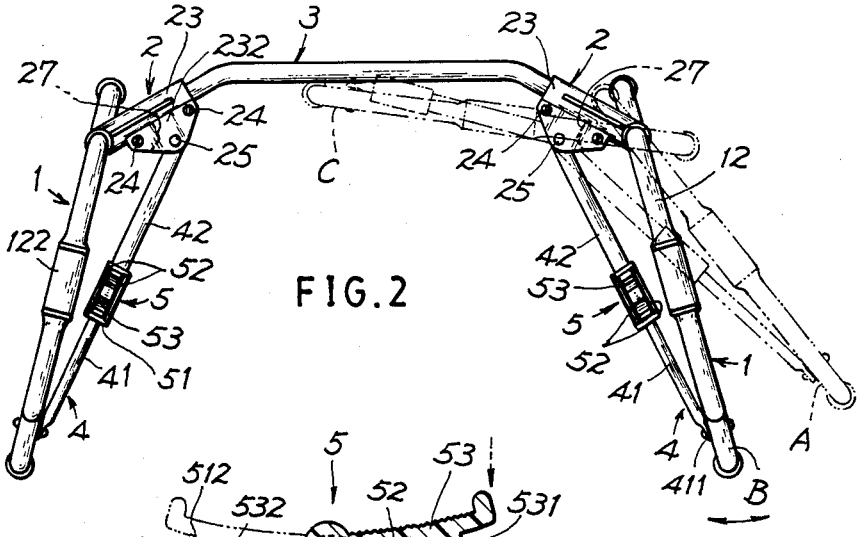
FIG. 2 is a top-view illustration showing the folding or extending operation of the present invention.
Figure 3:
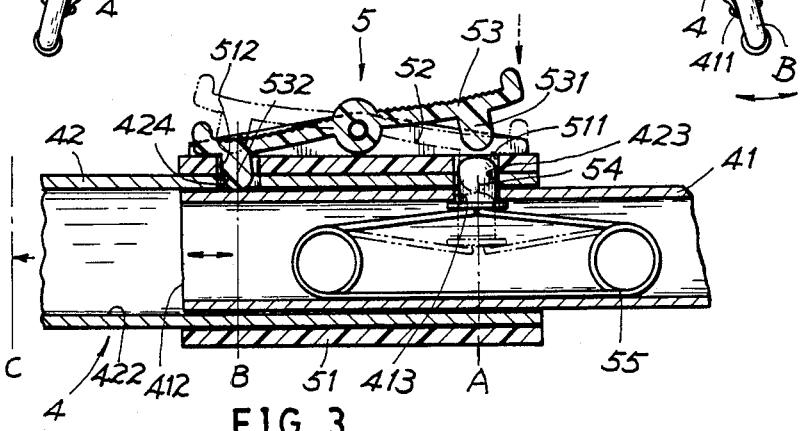
FIG. 3 is a sectional drawing of the seesaw controller of the present invention as viewed from I—I direction of FIG. 1.

When the walker of the present invention is to be folded from its outermostly extended position A as shown in FIGS. 2, 3 to position B, each user's hand can hold each seesaw controller 5 and the seesaw actuator 53 is depressed downwardly to allow the first bead 531 formed on the rear end of the actuator 53 to retract the button 54 downwardly through holes 511, 423 and button hole 413 to disengage the locking of the inner tube 41 from the outer tube 42, whereby upon the inward driving of the controller 5 to rotate the side member 1 around the sleeve portion 20, the inner tube 41 will be telescopically received into the outer tube 42 until the locking button 54 resiliently pokes into the second holes 414, 512 to lock the inner tube 41 with the outer tube 42, to thereby stabilize the side member 1 at position B as shown in full line of FIG. 2.

Still, the seesaw actuator 53 from the foregoing folding step (already under depression as shown in dotted line as shown in FIG. 3) is now further depressed to bias the second bead 532 downwardly to depress the button 54 through holes 512, 424 to unlock the inner tube 41 from the outer tube 42 and further driving of the controller 5 to pull the side member 1 will retract the inner tube 41 deeply into the outer tube 42 till the innermost collapsed condition as shown in position C. When extending the side member 1 to its outermost position (A), a stopper 27 is formed at the corner of the flanges 232 to limit the linking member 4 without further outward movement.

Accordingly, the present invention has the following advantages superior to a conventional foldable walker:

1. Just operating the seesaw controller by a single push-button action, the walker can be folded or extended in an easier, quicker and more convenient way. To depress the seesaw controller 5 and to drive the side member 1 can be simultaneously done by an user's single hand, especially helpful for the operation of a disabled or weak patient.

2. The D-shaped upper handle 11 or the T-joint means 2 is integrally made by injection or blow molding for saving production cost and increasing assembly convenience.

3. The T-joint means 2 plays a role for linking the side member 1, the front transverse bar 3 and the telescopic foot 16 together for quicker assembly and less production cost.

I claim:

1. A foldable walker comprising:

a pair of side walking members each including a D-shaped upper handle having a front bar fixed with a front telescopic foot and rotatably mounted in a vertical sleeve tube of a T-joint means and having a rear bar fixed with a rear telescopic foot;

a pair of T-joint means each including said vertical sleeve tube and a horizontal tube protruding from the vertical sleeve tube and being inserted with a respective one end of a front transverse bar adapted for combining two said side walking members as secured by said front transverse bar;

a pair of foldable linking members each having an inner tube secured to a rear telescopic foot and telescopically received in an outer tube pivotally secured to said horizontal tube of said T-joint means; and a pair of seesaw controllers each operatively seesawly biasing a locking button resiliently retained in said inner tube to operatively engage or disengage said inner tube with or from said outer tube, adapted for the extension or folding operation of each said side walking member as rotating around an axis of said sleeve tube while said inner tube being telescopically received in said outer tube;

the improvement which comprises:

said seesaw controller including:

a cylindrical portion fixed on a rear portion of the outer tube and having a first button hole and a second button hole respectively disposed on two sides proximate to its two extremities; a bracket formed on the cylindrical portion; a seesaw actuator having its central portion pivotally secured on the bracket and having two beads respectively extending downwardly from its two ends and operatively poking through two button holes disposed on the cylindrical portion and poking through the other two button holes formed on the rear portion of the outer tube corresponding to the two holes on the cylindrical portion; and a locking button resiliently extending upwardly through a button hole formed on the inner tube proximate to the front end of the inner tube as retained by a restoring spring fixed in the inner tube; said seesaw actuator operatively seesawly biasing the button extending through the button holes either formed on the rear side or front side of the outer tube and the cylindrical portion.

* * * * *